US007798081B2

(12) United States Patent
Yoon

(10) Patent No.: US 7,798,081 B2
(45) Date of Patent: Sep. 21, 2010

(54) BOTTOM THREAD SUPPLY DEVICE DETECTING RESIDUAL THREAD FOR A SEWING MACHINE

(75) Inventor: Kyoung Key Yoon, #103-710, Daesung Apt., 927-1 Mandeok-dong, Buk-gu, Busan 616-756 (KR)

(73) Assignee: Kyoung Key Yoon, Busan (KR)

( * ) Notice: Subject to any disclaimer, the term of this patent is extended or adjusted under 35 U.S.C. 154(b) by 809 days.

(21) Appl. No.: 11/718,599

(22) PCT Filed: Jul. 11, 2005

(86) PCT No.: PCT/KR2005/002223

§ 371 (c)(1),
(2), (4) Date: May 3, 2007

(87) PCT Pub. No.: WO2006/049383

PCT Pub. Date: May 11, 2006

(65) Prior Publication Data

US 2007/0261622 A1 Nov. 15, 2007

(30) Foreign Application Priority Data

Nov. 4, 2004 (KR) ..... 10-2004-0089285

(51) Int. Cl.
*D05B 51/00* (2006.01)

(52) U.S. Cl. ..... 112/278; 112/273; 200/61.15

(58) Field of Classification Search ..... 112/273, 112/278, 279, 470.01; 242/118.3, 118.32, 242/118.4; 200/61.15, 61.16
See application file for complete search history.

(56) References Cited

U.S. PATENT DOCUMENTS

| | | | | | |
|---|---|---|---|---|---|
| 3,845,320 | A * | 10/1974 | Winberg | 112/278 |
| 4,732,098 | A * | 3/1988 | Mertel et al. | 112/278 |
| 4,805,544 | A * | 2/1989 | Dobner et al. | 112/278 |
| 4,934,292 | A * | 6/1990 | Mardix et al. | 112/273 |
| 5,020,461 | A * | 6/1991 | Hanyu et al. | 112/278 |
| 5,027,730 | A * | 7/1991 | Dobner et al. | 112/278 |
| 5,103,750 | A * | 4/1992 | Sato et al. | 112/278 |
| 5,161,475 | A * | 11/1992 | Tawara et al. | 112/278 |
| 5,211,121 | A * | 5/1993 | Sakakibara | 112/278 |
| 5,267,518 | A * | 12/1993 | Arnold et al. | 112/278 |
| 5,353,726 | A * | 10/1994 | Bruder et al. | 112/278 |
| 5,651,324 | A * | 7/1997 | Arnold | 112/278 |
| 6,564,733 | B2 * | 5/2003 | Butzen et al. | 112/273 |
| 6,810,824 | B2 * | 11/2004 | Durville | 112/278 |
| 6,863,007 | B2 * | 3/2005 | Fluckiger | 112/475.01 |

* cited by examiner

*Primary Examiner*—Gary L Welch
*Assistant Examiner*—Nathan E Durham
(74) *Attorney, Agent, or Firm*—Joseph H. Kim; JHK Law

(57) ABSTRACT

Disclosed herein is a bottom thread supply device for sewing machines. The bottom thread supply device of the present invention includes a light source (500) and a light receiving sensor (110). When the light source (500) radiates light onto a bobbin (300), around which a bottom thread is wound, if there is no remaining thread, the light receiving sensor (110), which is disposed in a central portion of a rotary hook (100), detects the light, thus generating a signal to let a user know that there is no remaining thread. As such, when there is no remaining thread, the present invention automatically lets the user know this thanks to the operation of the light receiving sensor, thus preventing unproductive or defective sewing, thereby increasing productivity and preventing economic loss.

6 Claims, 4 Drawing Sheets

[Fig. 1]
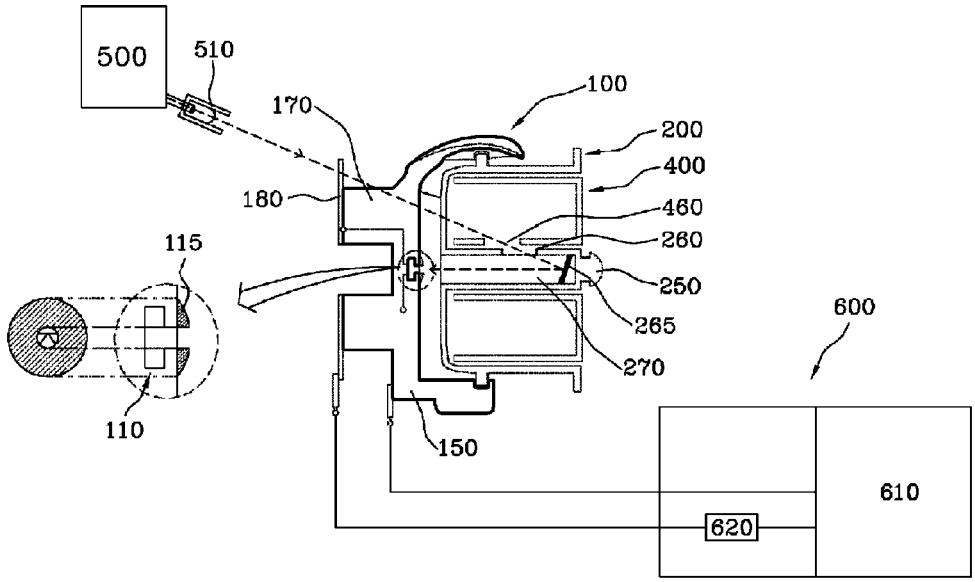
[Fig. 2]
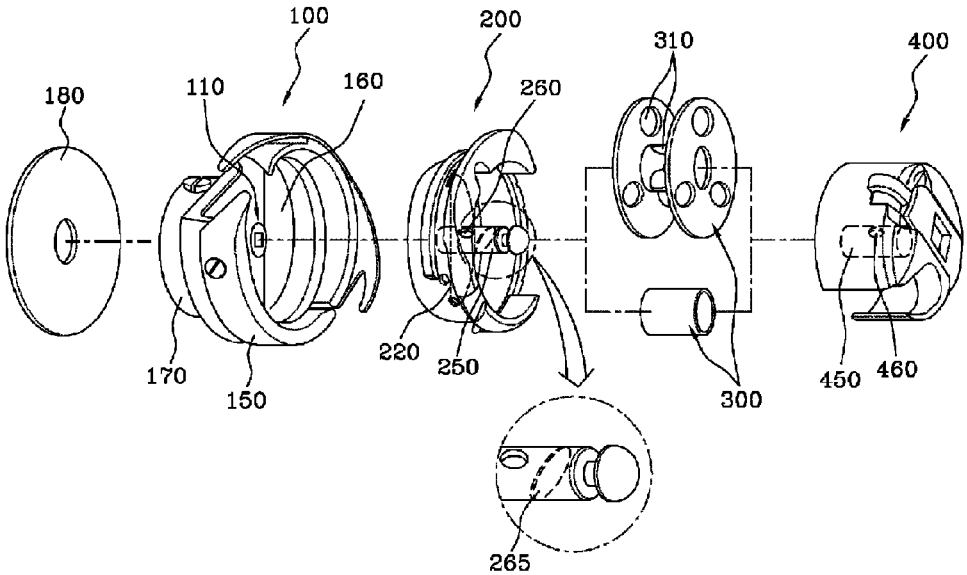

[Fig. 3]
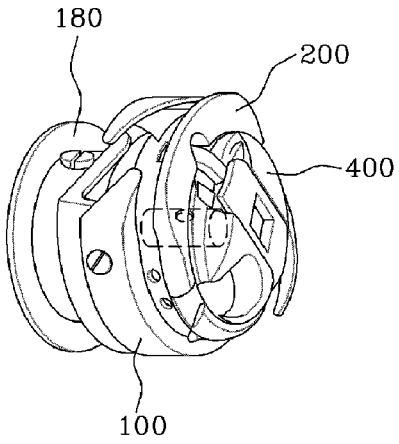
[Fig. 4]
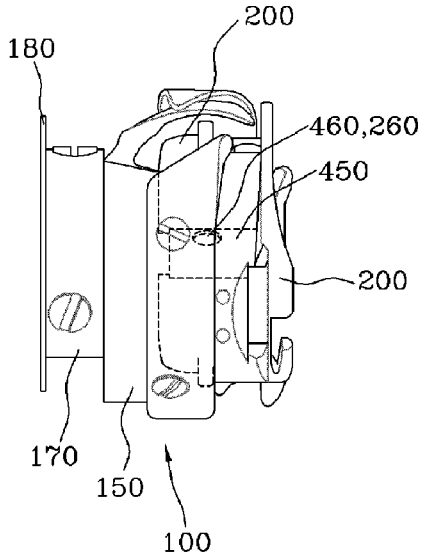
[Fig. 5]
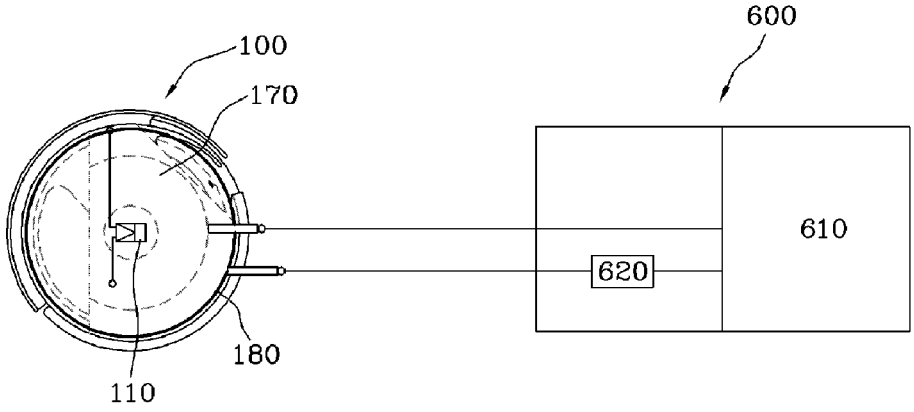

[Fig. 6]
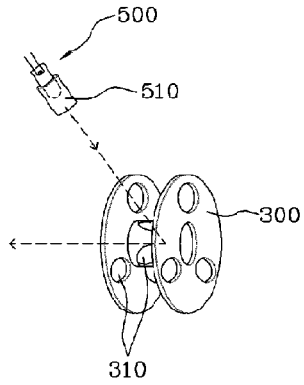
[Fig. 7]
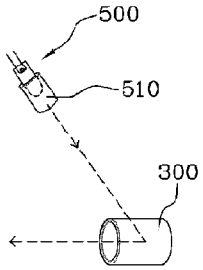
[Fig. 8]
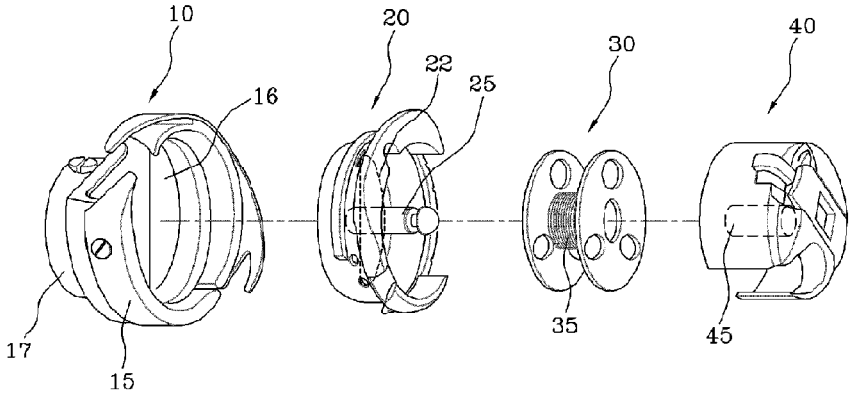
[Fig. 9]
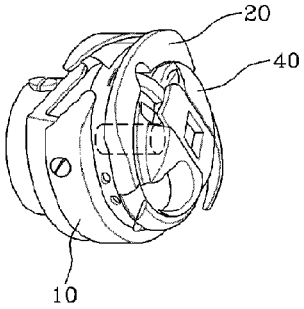

[Fig. 10]
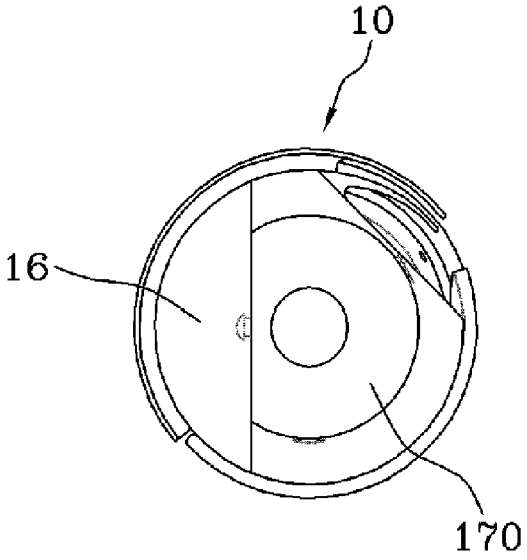
[Fig. 11]
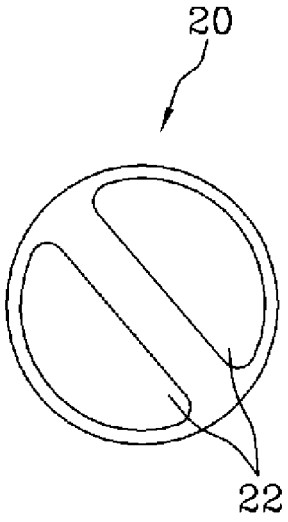

BOTTOM THREAD SUPPLY DEVICE DETECTING RESIDUAL THREAD FOR A SEWING MACHINE

TECHNICAL FIELD

The present invention relates, in general, to bottom thread supply devices for sewing machines having remaining thread detection functions and, more particularly, to a bottom thread supply device for sewing machines which includes a light source that radiates light onto a bobbin, around which a bottom thread is wound, so that, if there is no remaining thread, a light receiving sensor, which is provided at a central portion in a rotary hook, detects the light and generates a signal, thus letting a user know that no more remaining thread exists.

BACKGROUND ART

Generally, in sewing machines to be used for manufacturing sewn products and for weaving various fabrics, an article is sewn by combination of two threads classified into a bottom thread and an upper thread and by the operation of a needle.

The bottom thread is wound around a bobbin and is supplied by a bottom thread supply device including the bobbin. A representative example of such a conventional bottom thread supply device is shown in FIG. 8.

Furthermore, FIG. 9 is an assembled view showing the conventional bottom thread supply device. FIGS. 10 and 11 are rear views showing a conventional rotary hook and shuttle hook, respectively.

As shown in the drawings, the conventional bottom thread supply device includes a rotary hook 10, a shuttle hook 20, a bobbin 30, around which a bottom thread 35 is wound, and a bobbin case 40. The above-mentioned components have the following functions.

A rotating shaft 17 of the rotary hook 10 rotates along with a main body 15 of the rotary hook 10. Thereby, the bottom thread 35 is unwound from the bobbin 30, and inserted in both the shuttle hook 20 and the bobbin case 40, which are stationary.

However, the conventional sewing machine have no a remaining thread detection device. Therefore, during a sewing process, a user cannot know whether bottom thread 35 remains, thus resulting in unproductive sewing. This problem causes defective article, thus resulting in economic loss.

To solve the above-mentioned problems, a variety of techniques, which let a user know an appropriate time to replace a bottom thread 35 with another, have been proposed. Among them, a detecting device, which detects whether bottom thread 35 remains in a bobbin 30 using an optical sensor that detects light reflected by the bottom thread, was proposed in PCT Publication No. WO88/07099. However, due to mobility and variation in thickness of the bottom thread, there is a disadvantage of reduced accuracy.

Furthermore, in Korean Patent Laid-open Publication No. 96-0034515, whether remaining thread exists is determined using the number of rotations of a bobbin. However, it is difficult to apply this technique to a typical bottom thread supply device. Thus, there is a disadvantage of requirement of additional installation cost.

In an effort to overcome the problems experienced with the conventional techniques, the inventor of the present invention proposed several techniques in Korean Patent Application No. 10-2003-0020289, and Korean Utility Model Registration No. 20-0274005-0000, No. 20-0269008-0000 and No. 20-0330729-0000.

In Korean Utility Model Registration No. 20-0269008-0000, which is entitled 'SEWING MACHINE HAVING SHUTTLE THREAD DETECTION SENSOR', both a light receiving sensor and an elastic electrode, which couples an electrode of the light receiving sensor to a rotary hook, are provided in a shaft of a shuttle hook. A light source, which emits light, is disposed adjacent to a bottom thread supply device.

If no more bottom thread exists, the light receiving sensor detects emitted light and transmits a detection signal through the elastic electrode provided between the shaft of the shuttle hook and the rotary hook, thus letting a user know that there is no remaining thread.

However, because the elastic electrode is affected by physical force occurring during a process of unwinding the bottom thread from the bobbin, in the case of continued use, there is a disadvantage in that fine modulation is required.

To supplement the above-mentioned disadvantage, a bottom thread detection device of a sewing machine using an optical fiber was proposed in Korean Utility Model Registration No. 20-0330729-0000, which was filed by the inventor of the present invention and is characterized in that a light receiving sensor, provided in a shaft of a shuttle hook, is inserted at a central portion in a rotary hook, and an optical fiber is provided in the shaft of the shuttle hook so as to guide incident light to the light receiving sensor.

In this technique, because the light receiving sensor is disposed in the main body of the rotary hook, the elastic electrode, used in No. 20-0269008-0000, is not required. Therefore, the shaft of the shuttle hook does not physically contact the rotary hook, so that the installation is simplified. Furthermore, this technique solves the problem of fine modulation experienced with No. 20-0269008-0000.

However, when incident light that enters the shaft of the shuttle hook is transmitted to the light receiving sensor through the optical fiber in the shaft, due to increased light loss, there is a probability of a malfunction in which the incident light is not detected by the light receiving sensor. Furthermore, there is a disadvantage in which the light receiving sensor may operate erroneously due to scattered reflection of light.

As well, in order to increase detection efficiency of the light receiving sensor, superior light collection efficiency and light linearity of the light source, which emits light, have been required.

DISCLOSURE OF INVENTION

Technical Problem

Accordingly, the present invention has been made keeping in mind the above problems occurring in the prior art, and an object of the present invention is to provide a bottom thread supply device for a sewing machine which has a structure such that light emitted from a light source is reflected in a shaft and enters a light receiving sensor of a rotary hook.

Another object of the present invention is to provide a bottom thread supply device which includes a light source hood, which is provided in the light source to enhance light collection efficiency, and a sensor hood, which is provided in the light receiving sensor to prevent light from being transmitted in sideways directions, thus automatically letting a user know the exhaustion of remaining thread at a precise point of time, thereby preventing futile or defective sewing, and increasing productivity.

A further object of the present invention is to provide a bottom thread supply device which is able to be used in a typical sewing machine without an additional complex component, unlike the conventional bottom thread supply devices.

Technical Solution

In order to accomplish the above objects, the present invention provides a bottom thread supply device for a sewing machine having a remaining thread detection function, including: a rotary hook coupled to the sewing machine, and having a rotary hook body, in which a receiving seat having a rear slot is formed, and a rotating shaft protruding from an end of the rotary hook body; a shuttle hook inserted into the rotary hook, and including a receiving seat having a through slot in a rear surface thereof, and a shaft protruding from a central portion of the receiving seat of the shuttle hook; a bobbin case coupled to the shuttle hook, and having a receiving seat, and a coupling hollow shaft fitted over the shaft of the shuttle hook; and a bobbin fitted over the coupling hollow shaft of the bobbin case, with the bottom thread wound around the bobbin. The bottom thread supply device further includes: an electrode plate coupled to a rear end of the rotating shaft of the rotary hook, and a light receiving sensor, having a first pole connected to the electrode plate and a second pole connected to the rotary hook body, and inserted in the receiving seat of the rotary hook through both the rotary hook body and a central portion of the rotating shaft; a light source mounted in the sewing machine at a position adjacent to the rotary hook, so that the light source emits light into the rear slot of the rotary hook; a first through hole formed through a surface of the shaft of the shuttle hook so as to pass the light, which enters the through slot of the shuttle hook after passing through the rear slot of the rotary hook, and a reflecting plate disposed in the shaft of the shuttle hook at a predetermined angle so as to reflect the light, which passes through the first through hole of the shaft, onto the light receiving sensor of the rotary hook; a second through hole formed through a surface of the coupling hollow shaft of the bobbin case and corresponding to the first through hole formed in the shaft of the shuttle hook; and a sensor circuit unit, having a power supply unit, two poles of which are respectively connected to the electrode plate and the rotary hook body of the rotary hook, and a signal generating unit generating a signal when light is sensed by the light receiving sensor. The bobbin is constructed such that the light, which sequentially passes through the rear slot of the rotary hook and the through slot of the shuttle hook, is transmitted both into the second through hole formed in the coupling hollow shaft of the bobbin case and into the first through hole formed in the shaft of the shuttle hook, so that, when the bottom thread, which has been wound around the bobbin, has been completely used, the signal is generated, thus letting a user know that no more thread remains.

The shaft of the shuttle hook may be filled with a transparent filling substance to prevent a foreign substance held in the shaft from interfering with propagation of light, reflected by the reflecting plate of the shaft after passing through the first through hole of the shuttle hook.

The bobbin may be made of plastic material having high transparency, such that incident light, transmitted through the through slot of the shuttle hook, passes through the bobbin.

The bottom thread supply device may further include a plurality of passing holes formed in a shaft of the bobbin and guide plates of the bobbin at positions corresponding to a light path, such that incident light is transmitted from the through slot of the shuttle hook into the first through hole formed in the shaft of the shuttle hook.

The light receiving sensor may have a sensor hood protruding outwards from the light receiving sensor so as to increase light receiving efficiency and prevent malfunction due to scattered reflections of light transmitted in sideways directions.

The light source may have a light source hood protecting an outer sidewall of the light source to prevent light from being emitted sideways, thus increasing linearity of light and light collection efficiency.

Advantageous Effects

The present invention provides a bottom thread supply device for a sewing machine, which includes a light source having superior linearity of light and a light receiving sensor having increased light collection efficiency compared to prior arts, thus precisely detecting whether remaining thread exists.

Furthermore, the bottom thread supply device of the present invention automatically lets a user know the precise time point of elimination of remaining thread, thus preventing futile or defective sewing, thereby increasing productivity.

BRIEF DESCRIPTION OF THE DRAWINGS

FIG. 1 is a schematic sectional view of a bottom thread supply device for a sewing machine having a remaining thread detection function, according to the present invention;

FIG. 2 is a perspective view of the bottom thread supply device for the sewing machine having the remaining thread detection function according to the present invention;

FIGS. 3 and 4 respectively are a perspective view and a side view showing the assembled bottom thread supply device for the sewing machine having the remaining thread detection function, according to the present invention;

FIG. 5 is a schematic rear view showing the bottom thread supply device for the sewing machine having the remaining thread detection function, according to the present invention;

FIGS. 6 and 7 show a path of light which enters a bobbin, according to the present invention;

FIGS. 8 and 9 respectively are a perspective view and an assembled view showing a conventional bottom thread supply device; and FIGS. 10 and 11 are rear views showing a conventional rotary hook and shuttle hook, respectively.

DESCRIPTION OF THE ELEMENTS IN THE DRAWING

10, 100: rotary hook 15, 150: rotary hook body
16, 160: rear slot 17, 170: rotating shaft
20, 200: shuttle hook 22, 220: through slot of shuttle hook
25, 250: shaft of shuttle hook 30, 300: bobbin
35, 350: bottom thread 40, 400: bobbin case
45, 450: hollow coupling shaft 110: light receiving sensor
115: sensor hood 180: electrode plate
260: first through hole 265: reflecting plate
270: filling substance 310: passing hole of bobbin
450: hollow coupling shaft of bobbin case
460: second through hole
500: light source 510: light source hood
600: sensor circuit unit 610: power supply unit
620: signal generating unit

MODE FOR THE INVENTION

Hereinafter, a bottom thread supply device for a sewing machine having a remaining thread detection function according to a preferred embodiment of the present invention will be described in detail.

FIG. 1 is a schematic sectional view of the bottom thread supply device for the sewing machine having the remaining thread detection function according to the present invention. FIG. 2 is a perspective view of the bottom thread supply device for the sewing machine having the remaining thread detection function according to the present invention.

Furthermore, FIGS. 3 and 4 respectively are a perspective view and a side view showing the assembled bottom thread supply device for the sewing machine having the remaining thread detection function according to the present invention. FIG. 5 is a schematic rear view showing the bottom thread supply device for the sewing machine having the remaining thread detection function according to the present invention.

In a brief description of the bottom thread supply device of the present invention, the bottom thread supply device includes a light source 500 which emits light. A first through hole 260 is formed through a surface of a shaft 250 of a shuttle hook 200. A reflecting plate 265 is disposed in the shaft 250 of the shuttle hook 200 so as to reflect the light, which is emitted from the light source 500, onto a rotary hook 100. A second through hole 460, which corresponds to the first through hole 260 formed in the shaft 250 of the shuttle hook 200, is formed through the surface of a coupling hollow shaft 450 of a bobbin case 400.

The light source 500 is a device for emitting light. A typical light emitting diode (LED), which has superior light linearity and is operable using low voltage, suffices as the light source 500.

Furthermore, as shown in FIGS. 1 and 2, the light source 500 is disposed adjacent to a rear slot 160 of the rotary hook 100. It is preferable that the light source 500 include a light source hood 510, which protects an outer sidewall of the light source 500 to enhance linearity of light and prevent scattered reflections occurring due to other elements of the sewing machine, thus preventing light from being emitted sideways, thereby increasing light collection efficiency.

Particularly, as shown in FIGS. 6 and 7, the shape of the light source hood 510 is preferably a tube shape which is able to surround the light source 500, but it is not limited to this shape, of course.

Meanwhile, due to a foreign substance such as fine dust held in the shaft 250 of the shuttle hook which is provided with the reflecting plate 265, incident light reflected by the reflecting plate 265 may not reach a light receiving sensor 110 or may be abated.

In order to prevent the above-mentioned problem, the shaft 250 of the shuttle hook is preferably filled with a transparent filling substance 270. It is suitable to use plastic or optical fiber as the transparent filling substance.

Furthermore, as shown in FIGS. 6 and 7, to transmit incident light from the light source 500 into the second through hole 460 of the coupling hollow shaft 450 through a through slot 220 of the shuttle hook 200, a bobbin 300, which is placed in a receiving seat defined in the bobbin case 400, is preferably made of transparent material. Alternatively, the bobbin 300 may have a plurality of passing holes 310, which are formed both in a shaft of the bobbin 300 and in guide plates of the bobbin 300 at predetermined positions perpendicularly corresponding to each other.

In other words, the passing holes 310 are formed in the shaft and the guide plates of the bobbin 300 at predetermined positions perpendicularly corresponding to each other, such that incident light, transmitted from the through slot 220 of the shuttle hook, sequentially passes through one passing hole 310, formed in one guide plate, and one passing hole 310, formed in the shaft of the bobbin 300.

Particularly, plastic is preferably used as the transparent material. Furthermore, a typical bobbin having only a shaft without guide plates or a bobbin having both a shaft and guide plates may be selectively used as the bobbin 300.

As shown in FIG. 1, the light receiving sensor 110, which receives light from the light source 500 and converts it into an electric signal, is provided at a central portion in the rotary hook 100. A first pole of two poles of the light receiving sensor 110 is connected to the main body 150 of the rotary hook 100.

Particularly, it is preferable that the light receiving sensor 110 include a sensor hood 115, which protrudes outwards from the light receiving sensor 110 so as to receive light more efficiently, so that superior light collection efficiency is ensured and the light receiving sensor 110 is prevented from undesirably responding to incorrect incident light occurring due to scattered reflections (see, a partially enlarged view of FIG. 1).

As shown in FIGS. 1 through 5, an electrode plate 180, which has a circular plate shape, is coupled to a rear end of a rotating shaft 170 of the rotary hook 100 and circumferentially protrudes from the rotating shaft 170. The electrode plate 180 is connected to a second pole of the light receiving sensor 110.

The rotating shaft 170 is made of insulating material, thus preventing the electrode plate 180 from being electrically connected to the main body 150 of the rotary hook 100.

Preferably, the electrode plate 180 is connected to a first pole of a sensor circuit unit 600 in a brush type connection manner.

The electrode plate 180, which is rotated along with the rotary hook 100, has a circular or sectorial shape, such that the electric connection of the electrode plate 180 to the sensor circuit unit 600 is maintained.

Meanwhile, the sensor circuit unit 600 includes a power supply unit 610 and a signal generating unit 620. A first pole of the sensor circuit unit 600 is connected to the electrode plate 180, and its second pole is connected to the main body 150 of the rotary hook 100, so that the sensor circuit unit 600 is connected to the two poles of the light receiving sensor 110.

In the present invention, the main body 150 of the rotary hook 100 is coupled both to a drive shaft (not shown) of the sewing machine and to other elements made of metal. Therefore, the second pole of the sensor circuit unit 600 may be connected to an element coupled to the main body 150 but is not directly connected to the main body 150.

Furthermore, when the light receiving sensor 110 detects light, the signal generating unit 620 emits light or sound, thus letting a user know that no more bottom thread exists. Of course, the method of expressing the signal is not limited to any particular method.

As described above, in the present invention, when light emitted from the light source 500 reaches the light receiving sensor 110, the sensor circuit unit 600 let the user know that no more remaining thread exists. This process will be explained in detail with reference to the drawings.

Light is radiated from the light source 500 into the through slot 220 of the shuttle hook 200 after passing through the rear slot 160 of the rotary hook 100, which rotates.

Thereafter, when the incident light reaches the bobbin 300, if remaining bottom thread exists, the incident light cannot propagate further.

However, if there is no remaining bottom thread, the incident light penetrates the bobbin 300 or passes through the passing holes 310, which are formed in the shaft and the guide plates of the bobbin 300. Thereafter, the incident light sequentially passes through the second and first through holes 460 and 260, which are respectively formed in the coupling hollow shaft 450 of the bobbin case 400 and the shaft 250 of the shuttle hook 200.

Subsequently, the incident light, having passed through the second and first through holes 460 and 260, is reflected by the reflecting plate 265, which is disposed in the shaft 250, and, thereafter, enters the light receiving sensor 110, which is provided at the central position in the rotary hook 100.

As such, when the light receiving sensor 110 detects the incident light, the sensor circuit unit 600, which is connected to the light receiving sensor 110 by the two poles, generates a signal using the signal generating unit 620, thus letting the user know that no more remaining bottom thread exists.

Then, the user recognizes that there is no remaining bottom thread and interrupts the sewing process to load more bottom thread 35, thus preventing futile or defective sewing.

The invention claimed is:

1. A bottom thread supply device for a sewing machine having a remaining thread detection function, comprising: a rotary hook coupled to the sewing machine, and comprising a rotary hook body, in which a receiving seat having a rear slot is formed, and a rotating shaft protruding from an end of the rotary hook body; a shuttle hook inserted into the rotary hook, and comprising a receiving seat having a through slot in a rear surface thereof, and a shaft protruding from a central portion of the receiving seat of the shuttle hook; a bobbin case coupled to the shuttle hook, and comprising a receiving seat, and a coupling hollow shaft fitted over the shaft of the shuttle hook; and a bobbin fitted over the coupling hollow shaft of the bobbin case, with the bottom thread wound around the bobbin, further comprising:

an electrode plate coupled to a rear end of the rotating shaft of the rotary hook, and a light receiving sensor, having a first pole connected to the rotary hook body and a second pole connected to the electrode plate, and inserted in the receiving seat of the rotary hook through both the rotary hook body and a central portion of the rotating shaft;

a light source mounted in the sewing machine at a position adjacent to the rotary hook, so that the light source emits light into the rear slot of the rotary hook;

a first through hole formed through a surface of the shaft of the shuttle hook so as to pass the light, which enters the through slot of the shuttle hook after passing through the rear slot of the rotary hook, and a reflecting plate disposed in the shaft of the shuttle hook at a predetermined angle so as to reflect the light, which passes through the first through hole of the shaft, onto the light receiving sensor of the rotary hook;

a second through hole formed through a surface of the coupling hollow shaft of the bobbin case and corresponding to the first through hole formed in the shaft of the shuttle hook; and a sensor circuit unit, comprising: a power supply unit, two poles of which are respectively connected to the electrode plate and the rotary hook body of the rotary hook; and a signal generating unit generating a signal when light is sensed by the light receiving sensor, wherein the bobbin is constructed such that the light, which sequentially passes through the rear slot of the rotary hook and the through slot of the shuttle hook, is transmitted both into the second through hole formed in the coupling hollow shaft of the bobbin case and into the first through hole formed in the shaft of the shuttle hook, so that, when the bottom thread, which has been wound around the bobbin, has been completely used, the signal is generated, thus letting a user know that no more thread remains.

2. The bottom thread supply device according to claim 1, wherein the shaft of the shuttle hook is filled with a transparent filling substance to prevent a foreign substance held in the shaft from interfering with propagation of light, reflected by the reflecting plate of the shaft after passing through the first through hole of the shuttle hook.

3. The bottom thread supply device according to claim 1, wherein the bobbin is made of plastic material having high transparency, such that incident light, transmitted through the through slot of the shuttle hook, passes through the bobbin.

4. The bottom thread supply device according to claim 1, further comprising:

a plurality of passing holes formed in a shaft of the bobbin and guide plates of the bobbin at positions corresponding to a light path, such that incident light is transmitted from the through slot of the shuttle hook into the first through hole formed in the shaft of the shuttle hook.

5. The bottom thread supply device according to claim 1, wherein the light receiving sensor comprises:

a sensor hood protruding outwards from the light receiving sensor so as to increase light receiving efficiency and prevent malfunction due to scattered reflections of light transmitted in sideways directions.

6. The bottom thread supply device according to claim 1, wherein the light source comprises:

a light source hood protecting an outer sidewall of the light source to prevent light from being emitted sideways, thus increasing linearity of light and light collection efficiency.

* * * * *